US007246542B2

(12) United States Patent
Karol

(10) Patent No.: US 7,246,542 B2
(45) Date of Patent: Jul. 24, 2007

(54) HOLDING SOCKET FOR A WASHER NUT

(75) Inventor: Robert W. Karol, Garfield, NJ (US)

(73) Assignee: Hytorc, Inc., Mahwah, NJ (US)

( * ) Notice: Subject to any disclaimer, the term of this patent is extended or adjusted under 35 U.S.C. 154(b) by 0 days.

(21) Appl. No.: 11/212,409

(22) Filed: Aug. 26, 2005

(65) Prior Publication Data

US 2006/0042423 A1 Mar. 2, 2006

Related U.S. Application Data

(60) Provisional application No. 60/605,884, filed on Aug. 31, 2004.

(51) Int. Cl.
*B25B 13/06* (2006.01)

(52) U.S. Cl. ..... 81/121.1; 81/55; 81/125

(58) Field of Classification Search ..... 81/121.1, 81/55, 124.4, 13, 125
See application file for complete search history.

(56) References Cited

U.S. PATENT DOCUMENTS 2,770,157 A * 11/1956 Moreo ..... 81/125
2,805,594 A * 9/1957 Fogel ..... 81/125
5,429,018 A 7/1995 Miller
5,476,024 A 12/1995 Hsieh
5,832,792 A 11/1998 Hsieh
5,860,339 A 1/1999 Mikic et al.
6,098,501 A 8/2000 Sundstrom
6,655,888 B2 12/2003 Schultz
6,889,581 B2 * 5/2005 Chen ..... 81/125
2005/0034568 A1 * 2/2005 Junkers ..... 81/121.1

* cited by examiner

*Primary Examiner*—Hadi Shakeri
(74) *Attorney, Agent, or Firm*—Duane Morris LLP

(57) ABSTRACT

The present invention includes a driven socket for a female threaded fastener formed from hexagonal steel stock or trilobe, D shaped stock, or round stock with other gripping or holding means. The driven socket also includes six radial lobes located adjacent to one of the hexagon of equal length sides and equidistant from the center of the fastener for loosening and tightening the fastener. A method of the present invention includes the steps for removing or tightening a threaded fastener from a corresponding bolt comprising the steps of: positioning a socket over a washer-nut; positioning a key to align a locking ring having tabs into a slot in the fastener to hold the socket securely to the locking fastener; engaging a lobe on the fastener to place pressure on a leveraging portion of the socket; and wherein rotating the socket removes or tightens the fastener.

8 Claims, 6 Drawing Sheets

HOLDING SOCKET FOR A WASHER NUT

CROSS-REFERENCE TO RELATED APPLICATIONS

This application claims priority of the earlier filing date, under 35 U.S.C. 119, of U.S. Provisional Patent Application No. 60/605,884 filed Aug. 31, 2004.

BACKGROUND OF THE INVENTION

1. Field of the Invention

The present invention relates to a socket apparatus and a method for applying the socket to tightening and removing a tensioning fastener.

2. Description of the Related Art

The present invention relates to a holding socket for tightening and removing a unique tensioning device and method for applying a unique tensioning device in an assembly of combined parts in a pre-determined order in order to achieve a proper tension in a machine bolt, a stud, or a screw. Furthermore, the invention satisfies the need for a device that holds a driving and holding socket onto a fastener in an inverted position without the need for an individual to hold the socket in position.

Users of high torque tensioning devices need ways to overcome contact friction in the related components of nuts, and associated locking washer-nuts of the type to be more fully described in the accompanying specification where additional information relating to the components is defined, as well as the frictional and loading criteria for achieving the desired end result of a tensile loaded machine rod, bolt, stud or screw that clamps together parts, plates, or other components.

Users of the fasteners of the type to which this invention is directed employ an axial drive socket to engage the outer members of female fasteners. The drive socket includes a plurality of substantially equally spaced and sized flat surfaces and associated outwardly radially projecting surfaces which receive a mating female fastener. However, for rapid assembly and disassembly operations a substantial clearance is required between the hex shaped female fastener and the driven socket, over which the driver is inserted.

A further problem in the removal of a hex nut is that when a hex socket driver is rotated past the female fastener it causes the hex socket to wedge itself or bind within the socket. After setting the desired torque between the male threaded fastener and the female threaded fastener, rotation of the hex shaped socket must be reversed to break the bind between the hex female fastener and the hex shaped socket.

With the foregoing in mind, the present invention will be distinguished over the prior art in the description and application of new components, design criteria and utility to the field of the invention.

SUMMARY OF THE INVENTION

The present invention includes a driven socket for a female threaded fastener formed from hexagonal steel stock or trilobe, D shaped stock, or round stock with other gripping or holding means. The driven socket includes six radial lobes located adjacent to each one of six hexagon sides of equal length and equidistant from the center of the fastener for loosening and tightening the fastener. The socket also includes an engaging locking ring member having a plurality of tabs to locate associated slots at a periphery location such as an apex of the six hexagon sides of the fastener to prevent the socket from falling from the fastener during removal or tightening of the bolt.

An embodiment of the present invention also includes an assembly and disassembly operation of the threaded fastener from the corresponding bolt comprising the steps of: positioning the socket over a washer-nut; positioning a key to align the locking ring having tabs into the slot in the fastener to hold the socket securely to the locking fastener; engaging the six hexagon side lobes on the fastener and placing pressure on a leveraging portion of the socket; and rotating the socket in a counter direction to remove or tighten the fastener.

DESCRIPTION OF THE DRAWINGS

The objects and advantages of the present invention will be apparent upon consideration of the following detailed description, taken in conjunction with accompanying drawings, in which like reference characters refer to like parts throughout, and in which.

DETAILED DESCRIPTION OF THE INVENTION

Figure 1B:
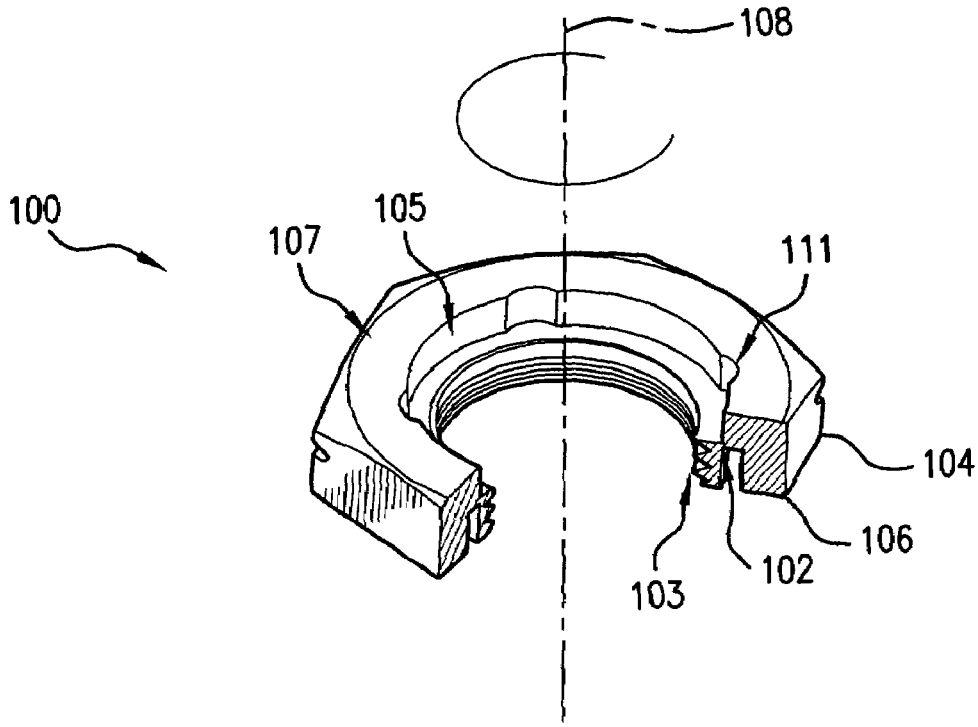
FIG. 1*b* is a cut-a-way view of the washer-nut of FIG. 1*a;*
Figure 1A:
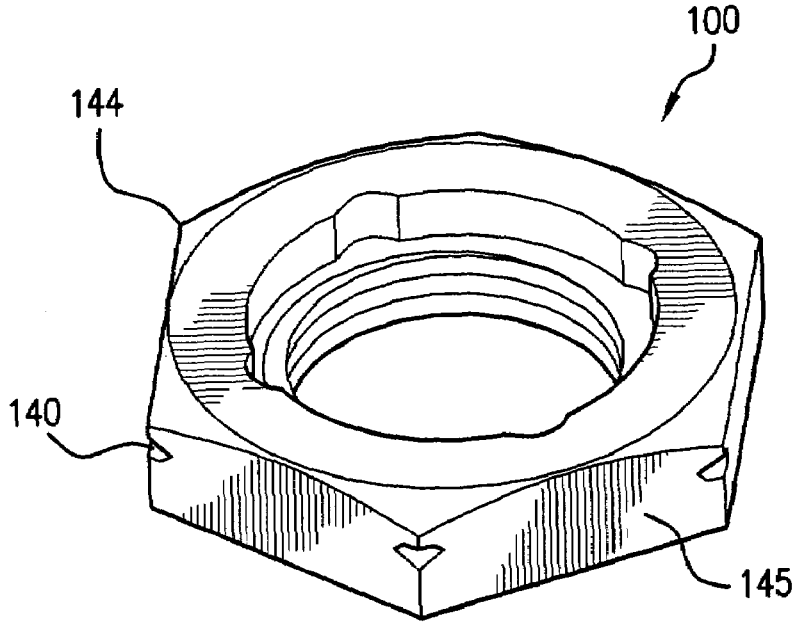
FIG. 1*a* is an isometric view of a washer-nut with assembled threaded segments.

In describing the present invention, reference is made to the drawings, wherein there is shown in FIG. 1*a* an embodiment of a washer-nut 100 also known as a tensioning device. As shown in cut-a-way FIG. 1*b*, the washer-nut 100 is formed into an assembly comprised of at least one internal segment 102 that is held by a washer-nut body 104. The washer-nut body 104 is formed from hexagonal steel stock (or trilobe, D shaped stock, or round stock with other gripping or holding means referred to as lobes 145, and such that an internal diameter 105 is formed by machining through a center axis (or axis) of the washer-nut body 104. In FIG. 1*b*, the washer-nut body 104 has a bearing surface 106 and a second nut bearing surface 107. The segment 102 also has a thread 103 that is concentric and co-axial with the center axis 108 of the washer-nut body 104. The washer-nut 100 contains a lock groove 140 on each periphery location such as apex 144 of the hexagonal lobe or outer edges 145.

Figure 2:
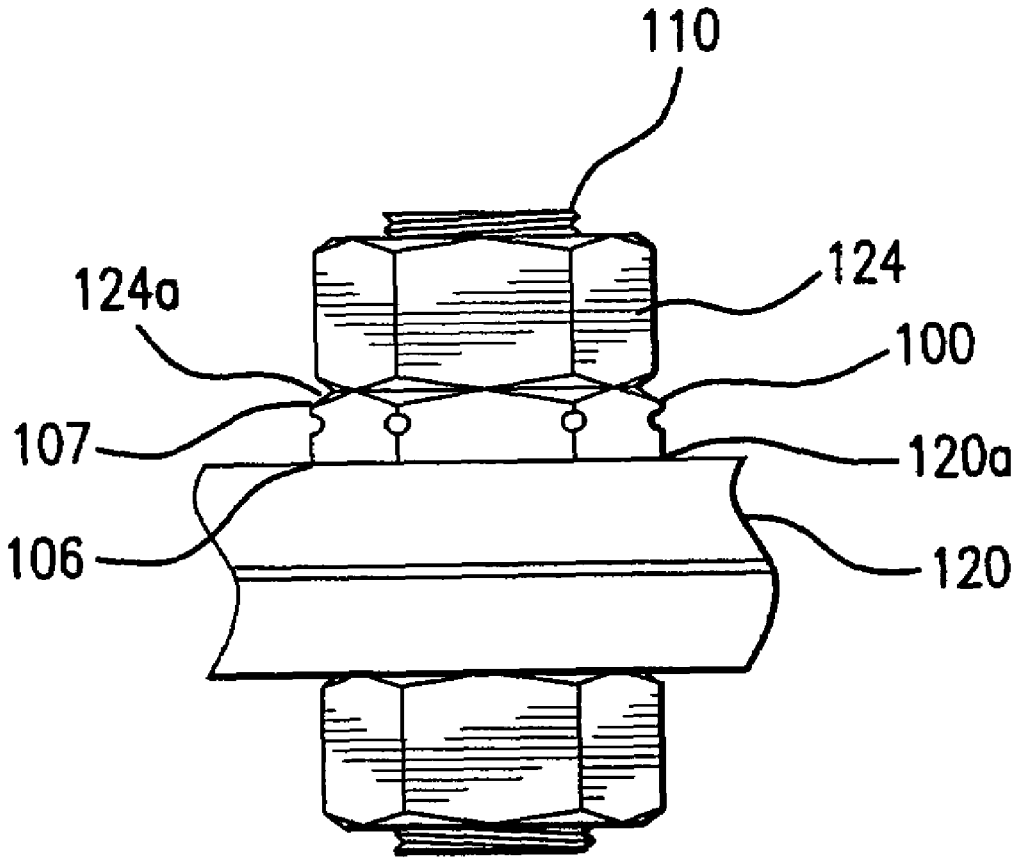
FIG. 2 is a general component drawing of the parts of the washer-nut as applied to a rod and an object.

The assembly of the washer-nut 100 will now be described as it is secured to a rod 110 shown in FIG. 2. The rod 110 may be a stud, a bolt, a threaded shaft, or other threaded member that is securely fastened, connected, joined, welded, secured with a locknut or otherwise assembled to an object 120 referred to variously as a flange. Referring to FIG. 2, the washer-nut 100 is initially threaded on the rod 110, until the first planar end (or first outer surface located at one axial end) 106 is in contact with the flange or object 120 at a surface 120*a*. A second nut 124, which may otherwise be another form of pressure device, is shown as applied to the washer-nut 100.

Figure 3:
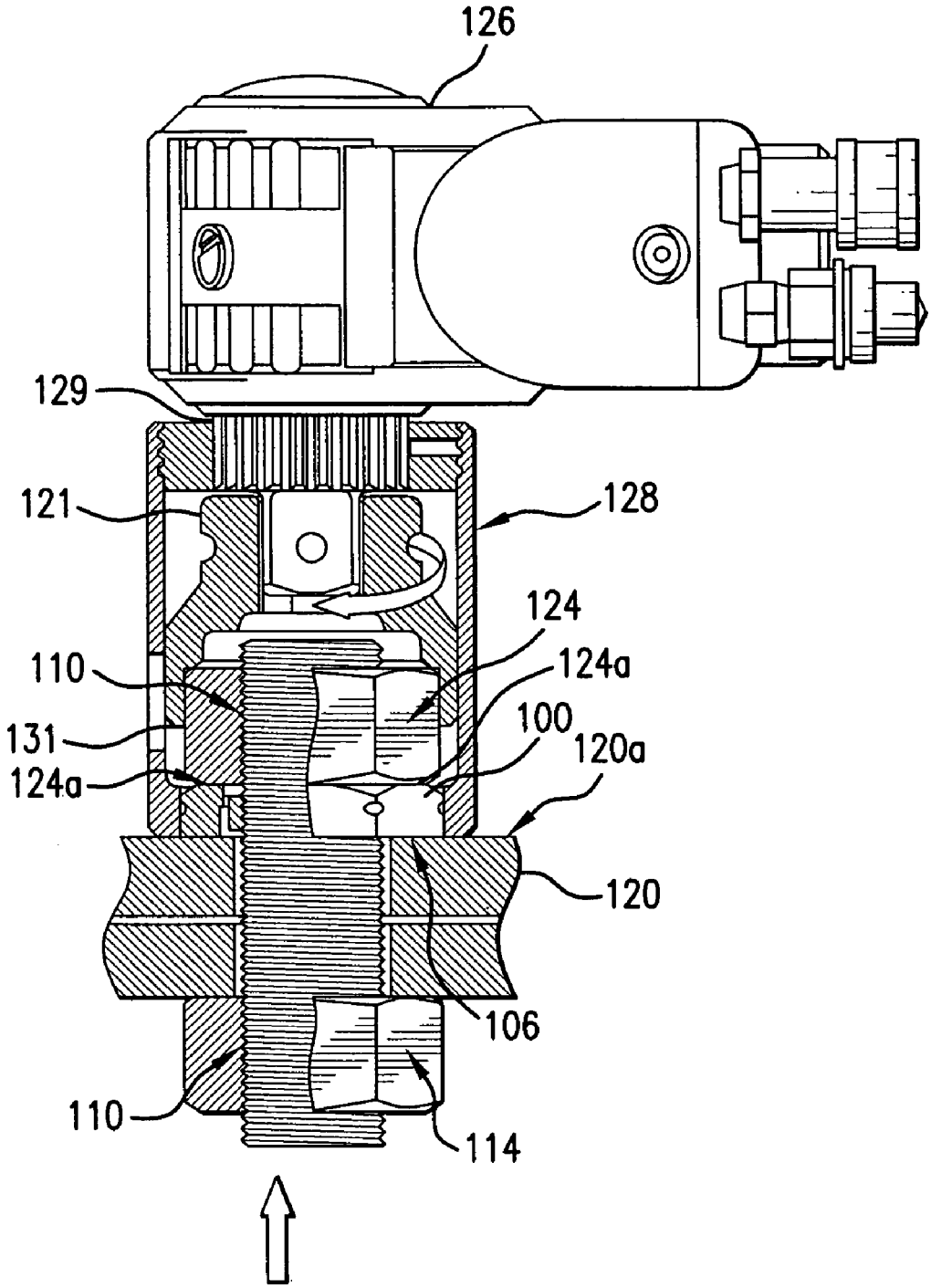
FIG. 3 is a view of the washer-nut illustrating details of the holding socket and a power tool.

In FIG. 3 a power tool 126 is illustrated as it would be applied to the nut 124 in supplying a torque in the assembly of the object 120 and the application of the washer nut device 100. The torque is converted to a normal force that is utilized to provide the lengthening and resulting tension in the rod 110. A holding socket 128 connects to the power tool 126 through a spline 129. At surface 131 of the nut 124, the holding socket 128 grasps the nut 124 in the grip of the driving portion 121 of the socket 128. The holding socket 128 also provides a locking or holding function to statically arrest the holding socket to the outer edges 145 of washer nut in a stabilized condition. The power tool 126 is activated and a pre-determined torque is applied to the nut 124. A resulting initial friction resistance is generated between a surface 124*a* and the planar end of washer-nut surface 107 of the washer-nut body 104 as a result of the normal force $F_n$ generated.

The bolt 110 is held stationary by imparting additional static friction with the washer-nut inner ring 102 that connects the washer-nut body 104 and inner thread 103. When the nut 124 is tightened against the washer-nut 100, the nut 124 acts like a jam nut against the washer-nut 100, creating a force on the thread 103, holding the bolt 110 from rotating. The friction between flange face 120*a* and washer-nut bottom surface 106 holds the washer-nut 100 in place and keeps the tool 126 from rotating. As the bolt 110 is elongated, the thin section 102 in the washer-nut 100 will shear thus allowing the threaded ring 103 to travel upward with the bolt 110. This initial shear force is approximately 5000 pounds per 1 inch of bolt 110 radius. The four ears, created in the cutouts 111 when the ring shears through, keep the threaded ring 103 from rotating in the washer-nut 100, maintaining an axial movement. The break edge on the threaded ring 103 maintains in contact with the bore in the washer-nut 100 creating consistent static friction to the bolt 110 of approximately 500 to 900 pounds throughout the bolt 110 entire elongation range. As a result of the unique method of elongating the bolt 110 through the application of forces on the nut 124 and the washer-nut 100, the holding socket 128 is required to provide features to assist in the removal of the nut 124 from the bolt 110, and the washer-nut 100 from removal from the bolt 110, as well.

Figure 4:
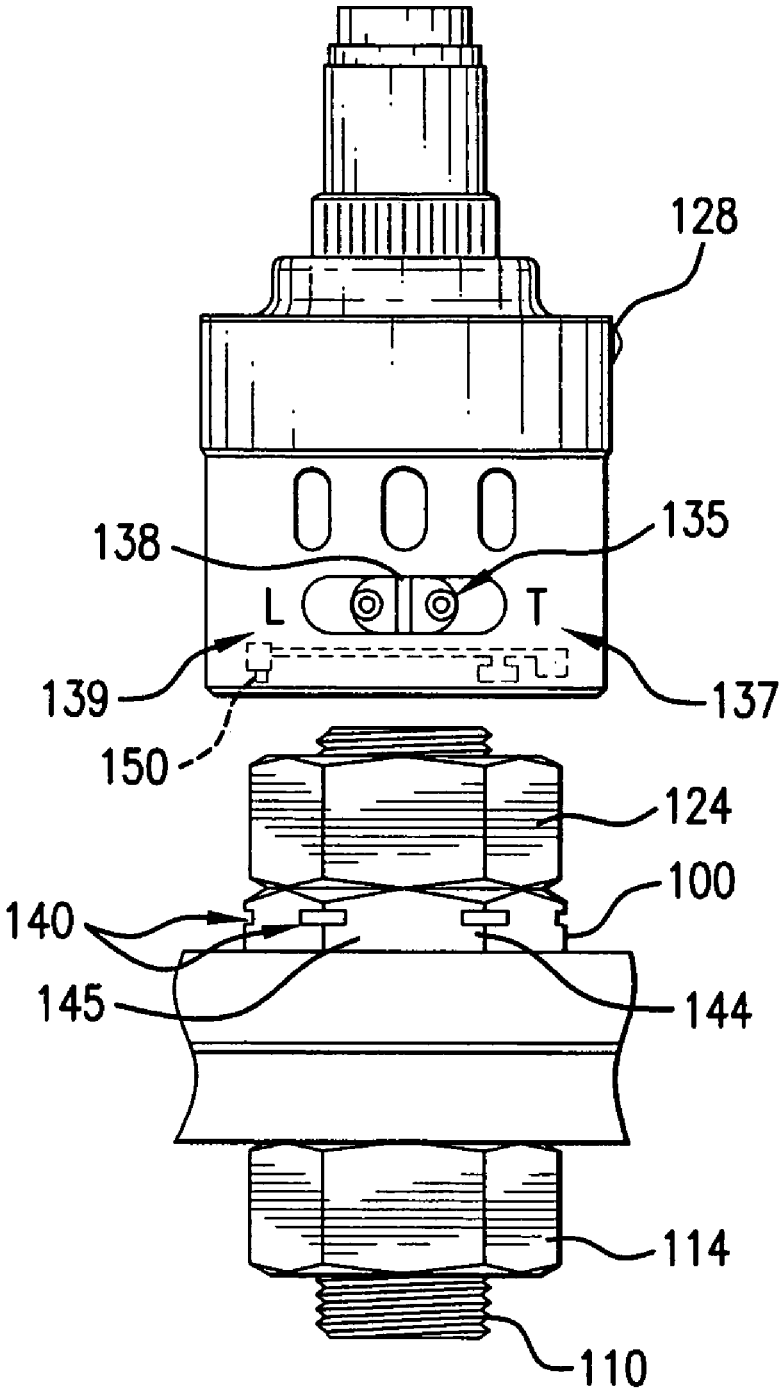
FIG. 4 is a view of the washer-nut illustrating the holding socket.

In FIG. 4 the holding socket 128 is shown suspended above the nut 124. The holding socket 128 includes a key 138, which is set in position 137 to tighten the nut 124 and set in position 139 to loosen the nut 124. In position 135 the holding socket 128 is in a neutral position and as such can be positioned onto the nut 124 or removed from the nut 124.

The washer-nut 100 contains a lock groove or slot 140 on each apex 144 of the hexagonal lobe or outer edges 145. A locking ring 150 housed in the Socket 128 engages the slots 140. The locking ring 150 has as its function to engage the washer-nut 100 slots 140 during the tightening and the removal of the washer-nut 100 from the stud 110.

Figure 5:
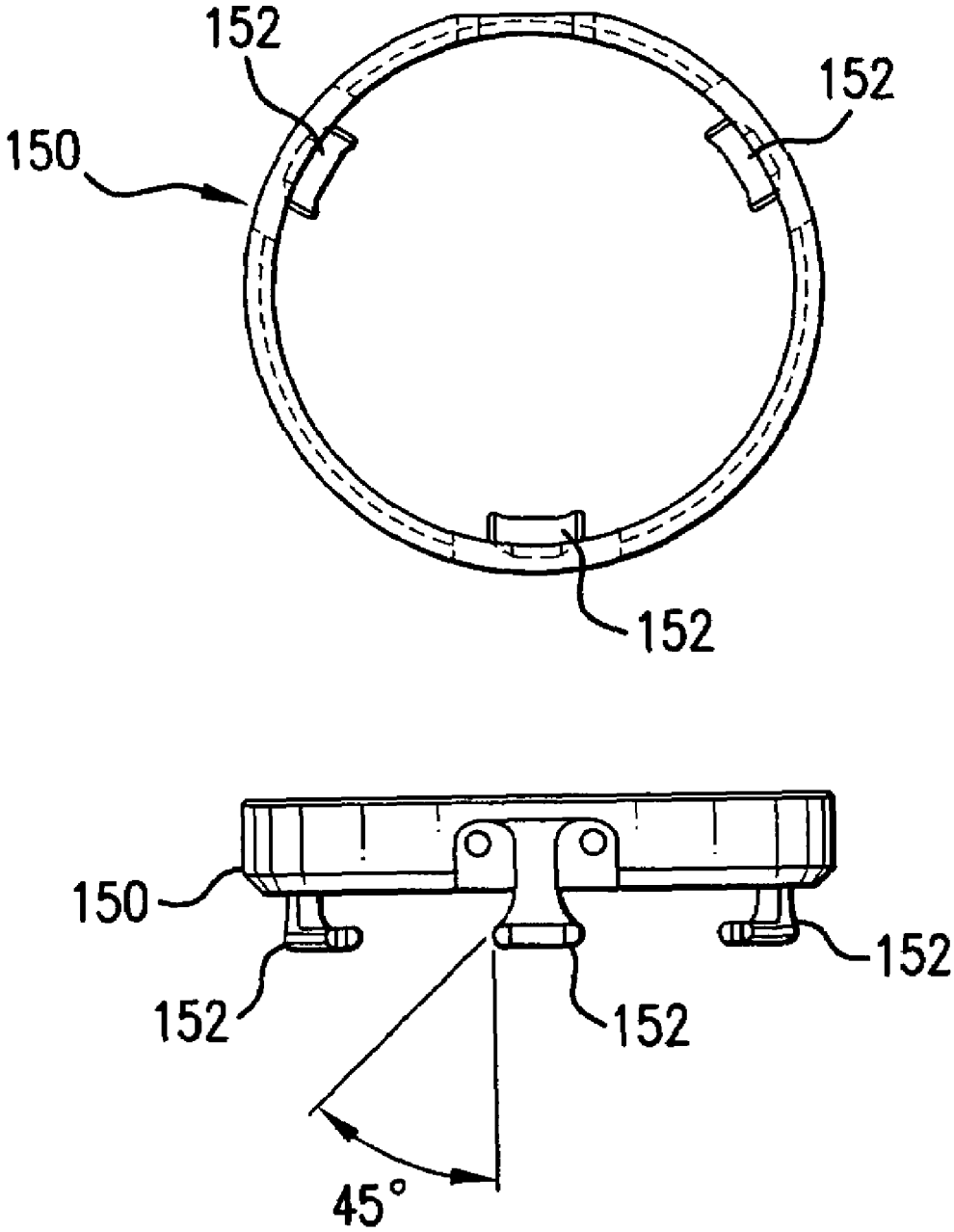
FIG. 5 is a view of the locking ring.
Figure 6B:
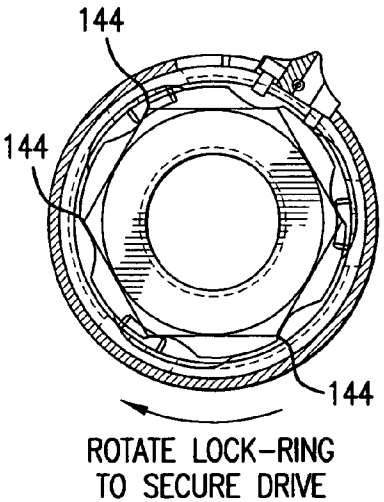
FIGS. 6*a*-6*d* are views of the inner working of the washer-nut illustrating additional details of the holding socket.
Figure 6A:
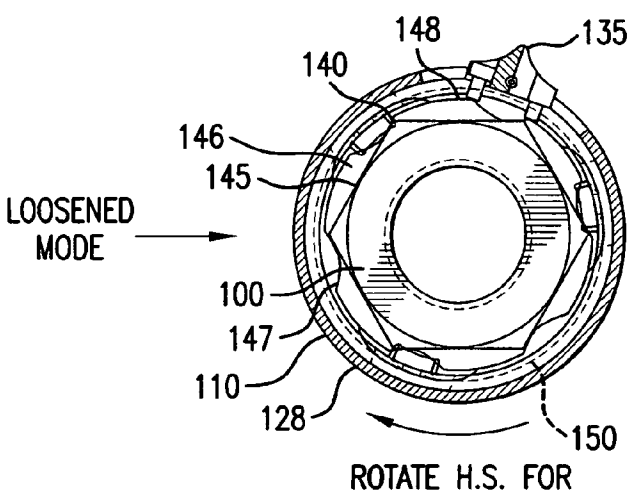
Figure 6D:
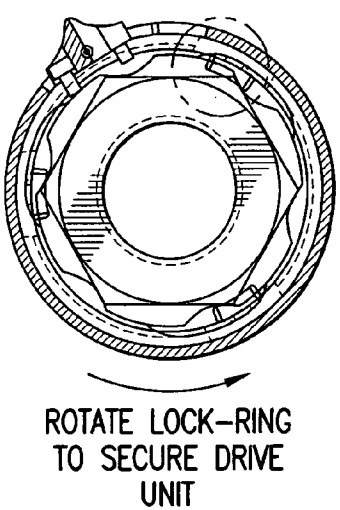
Figure 6C:
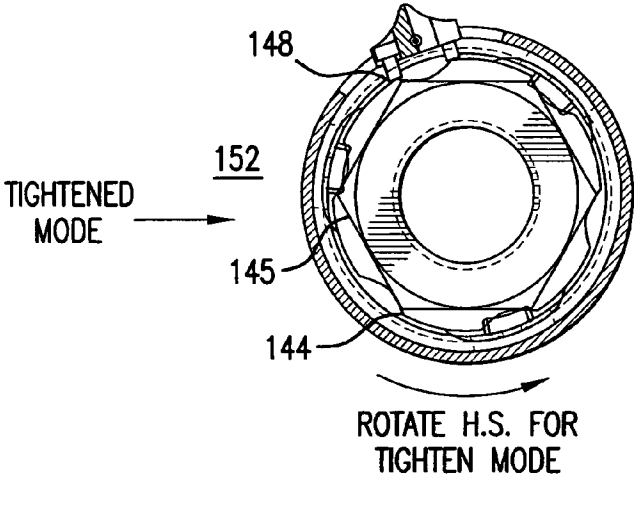

FIG. 5 in the lower view illustrates the locking ring 150 having three "L" shaped tabs 152 circumferentially spaced 120 degrees apart as shown in FIG. 5 top view. The tabs 152 are able to fit into the flat or a hexagonal position of the lobe 145 of the washer nut 100 such that a rotation of the key 138 brings the tabs 152 into the position of the slots 140, as more fully illustrated in FIG. 6.

With reference to FIG. 6*a*-6*d*, the socket 128 for removing the washer-nut 100 from the corresponding bolt 10 includes lobes 148 radially positioned on the internal periphery the socket 128, the lobes 148 being located substantially equidistant from the center and approximately sixty (60) degrees apart from each other; the locking ring engaging member 150 having the plurality of tabs 152 locates the plurality of associated slots 140 at the apex 144 of the fastener 100 to prevent the socket 128 from falling outside the fastener 100 when the fastener 100 is removed from or tighten on the bolt 110.

As the nut 124 is to be loosened from the stud 110. The locking ring 150 is positioned in FIG. 6 view (a) such that key 138 is in position at 135 where the tabs 152 are in the space above the holding socket engage lobes 147. The holding socket space 146 allows clearance for rapid insertion and removal of the socket 128 regardless of nut 124 and washer nut 100 angular orientation (nut 124 not show for clarity). In FIG. 6 view (b) the key 138 is rotated clockwise to position 139. The tabs 152 are inserted into the slots 140 to firmly hold the socket 128 in engagement, such that the lobe 148 contacts the periphery location such as apex 144 of hexagonal outer surface 145. When locked in place the socket 128 will rotate a few degrees counter-clockwise until the radius of the socket 128 backs-up the locking ring tabs 152 placing pressure on apex 144. When locked in place the socket 128 cannot rotate clockwise because the holding socket 128 flat portion of the lobe 147 contacts the washer-nut 100. As further illustrated in FIG. 6 view (b) once the socket 128 is secure, the power tool 126 is energized to turn the inner driving portion in a counterclockwise direction to loosen the nut 124. Once the nut 124 is loosened, the locking ring 150 is rotated counterclockwise to position 135, allowing the tool and socket assembly to be removed from the nut and washer nut. Further disassembly is carried out by hand.

As the nut 124 is to be tightened on the stud 110 the socket 128 is placed over the washer-nut 100. The locking ring 150 is positioned in FIG. 6 view (c) such that key 138 is in position at 135 where the tabs 152 are in the space above the holding socket engage lobes 147. In FIG. 6 view (d) the key 138 is rotated counter-clockwise to position 137 the tabs 152 are inserted into the slots 140 to firmly hold to the socket 128 in engagement, such that the lobe 148 contacts the apex 144 of hexagonal outer surface 145. When locked in place the socket 128 will rotate a few degrees clockwise until the radius of the socket 128 backs up the locking ring tabs 152 placing pressure on apex 144. When locked in place the socket 128 cannot rotate counter-clockwise because the holding socket 128 flat portion of the lobe 147 contacts the washer-nut 100. As further illustrated in FIG. 6 view (d) once the socket 128 is secure, the power tool 126 is energized to turn the inner driving portion in a clockwise direction to tighten the nut 124. Once the nut 124 is tightened, the locking ring 150 is rotated clockwise to position 135, allowing the tool and socket assembly to be removed from the nut and washer nut. Essentially the invention herein us used when the fastener is placed up or removed from the bolt to prevent it from falling outside the bolt.

An embodiment of the method of the present invention further includes loosening the washer-nut 100 following the steps of: positioning the socket 128 over the nut 124 and washer-nut 100; positioning the key 138 to align the locking ring 150 having tabs 152 into slots 140 in the locking ring 150 to hold the washer-nut 100 securely to the socket 128; engaging a lobe 145 on the washer-nut 100 for placing pressure on a leveraging portion of the socket 128; engaging the socket 128 to the nut 124 in preparation for rotation; applying a holding force to the washer-nut 100 to enhance a cooperation between at least one internal segment in the washer-nut 100 and the one end of the rod 110 to obtain a moving friction between the internal segment 103 and the one end of the rod 110 wherein the washer-nut 100 is adapted to cooperate with the object 120 to be tightened or loosened; connecting a holding force to lock the washer-nut 100 to prevent movement and applying a holding force to the body of the washer-nut 100 so that the nut 124 rotates upon a rotational force and the rod 110 encounters a moving friction with the internal segment 103 in order to maintain the rod 110 substantially free of rotation while the rod 110 elongates or relaxes in an axial direction resulting in a tightening or loosening of the rod 110 in the object 120, while the nut 124 moves in the axial direction against the at least one internal surface 103.

While the present invention has been disclosed and described with reference to several variations and embodiments thereof, it will be apparent, as noted above that additional variations and modifications may be made therein. It is also noted that the present invention is independent of the machine being controlled, and is not limited to the application described in the enclosed background. It is, thus, intended in the following claims to cover each variation and modification that falls within the true spirit and scope of the present invention.

What is claimed is:

1. A socket for engaging a locking fastener and a nut attached to a corresponding bolt comprising:

a driving portion for engaging the nut;

lobes radially positioned on the internal periphery of the socket;

an engaging member including a key and a locking ring having a plurality of L-shaped tabs, wherein a rotation of the key brings the tabs of the locking ring to locate a plurality of associated slots at a periphery location of the fastener to prevent the socket from falling outside the fastener when the fastener is placed upon or removed from the bolt.

2. The socket of claim 1, wherein each of the lobes projects outward toward the center of the fastener.

3. The socket of claim 1, wherein each of the lobes forms a substantially smooth outer surface.

4. The socket of claim 1, wherein the lobes are positioned to provide a first clearance between the periphery location of each of the lobes and corresponding surfaces on a hex fiat surface to provide a second clearance between the lobes and corresponding surfaces on the hex fiat surfaces.

5. The socket of claim 1, wherein the lobes are located substantially equidistant from the center and approximately 60 degrees from each other.

6. The socket of claim 1, wherein, placed upon or removed from the bolt, includes loosening and tightening the fastener.

7. A method of engaging threaded fasteners attached to an object through a threaded rod comprising the steps of:

positioning a socket over a nut and a locking fastener;

positioning a key to align a locking ring having L-shaped tabs into slots in the locking fastener to hold the socket securely to the locking fastener;

engaging a lobe on the locking fastener for placing pressure on a leveraging portion of the socket;

connecting a driving portion of the socket to the nut in preparation for rotation;

applying a holding force to the locking fastener the locking fastener having at least one internal surface arranged to enhance a cooperation between at least one internal segment in the locking fastener and the one end of the rod to obtain a moving friction between the internal segment and the one end of the rod connecting a holding force to lock the locking fastener to prevent movement and applying a holding force to the body of the locking fastener so that the nut rotates upon a rotational force and the rod encounters a moving friction with the internal segment in order to maintain the rod substantially free of rotation while the rod moves in an axial direction and the nut moves in a rotational direction.

8. The method of claim 7 engaging the threaded fasteners includes loosening and tightening the fasteners.

* * * * *